United States Patent [19]

Fleissner

[11] Patent Number: 4,520,637

[45] Date of Patent: Jun. 4, 1985

[54] STEAMING DEVICE ARRANGED IN FRONT OF A SYNTHETIC FIBER CRIMPING INSTALLATION FOR HEATING FIBERS TRAVELING PAST SUCH STEAMING DEVICE

[75] Inventor: Heinz Fleissner, Riehen, Switzerland

[73] Assignee: Vepa Aktiengesellschaft, Riehen/Basel, Switzerland

[21] Appl. No.: 456,764

[22] Filed: Jan. 10, 1983

[51] Int. Cl.[3] ..... D06B 5/04

[52] U.S. Cl. ..... 68/5 D; 28/265

[58] Field of Search ..... 68/5 D, 5 E, 6; 28/265; 34/155, 160; 432/8, 59

[56] References Cited

U.S. PATENT DOCUMENTS

| | | | |
|---|---|---|---|
| 1,432,735 | 10/1922 | Reed et al. | 34/160 X |
| 2,346,186 | 4/1944 | Poesl | 68/6 |
| 2,590,850 | 4/1952 | Dungler | 68/5 D X |
| 2,972,836 | 2/1961 | Mowrey et al. | 34/155 X |
| 3,326,022 | 6/1967 | Drago | 68/5 D |
| 3,816,583 | 6/1974 | Kashima et al. | 28/265 |

FOREIGN PATENT DOCUMENTS

| | | | |
|---|---|---|---|
| 477234 | 7/1953 | Italy | 34/160 |
| 8537 | 3/1973 | Japan | 68/5 D |
| 362083 | 2/1973 | U.S.S.R. | 68/5 D |
| 726237 | 4/1980 | U.S.S.R. | 68/5 D |

*Primary Examiner*—Philip R. Coe

*Attorney, Agent, or Firm*—Antonelli, Terry & Wands

[57] ABSTRACT

The steaming device consists of two halves, one of which is arranged above a fiber route and the other of which is arranged below the fiber route. The steam expands, from a steam supply nipple extending into a U-shaped housing, first into a distributor chamber covered by a partially permeable metal sheet. The metal sheet exhibits perforated zones arranged at mutual spacings, these zones being located with respect to the zones of a further perforated metal sheet, arranged thereabove at a spacing, in such a way that permeable regions of one metal sheet are disposed oppositely to impermeable regions of the other metal sheet. A heater is provided between the two perforated metal sheets. The halves of the steaming device are mounted so that they can be swung open and are regulated by means of a steam supply safety circuit.

6 Claims, 3 Drawing Figures

Figure 1:
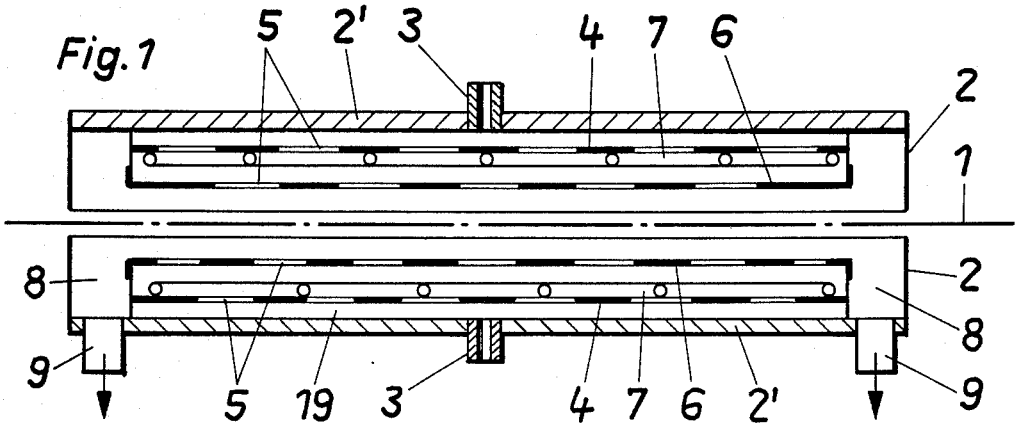

STEAMING DEVICE ARRANGED IN FRONT OF A SYNTHETIC FIBER CRIMPING INSTALLATION FOR HEATING FIBERS TRAVELING PAST SUCH STEAMING DEVICE

The invention relates to a device to be arranged in front of a synthetic fiber crimping installation for heating the fibers travelling past the device.

It is known to draw synthetic fibers, smoothly spun in a plurality of spinnerets, in order to impart strength to these fibers, and to stuffer-crimp the fibers, for example, in a mechanical crimping installation in order to obtain a crimped structure. It is furthermore known to conduct the drawing process for the fibers at an elevated temperature lying in any event below the glass transition point of the fibers. The drawn condition is fixed at the outlet of the drawing line by cooling of the fibers.

Crimping installations for producing a crimped structure similar to that of a natural fiber have been known in a great variety of constructions. In this connection, worth mentioning, in particular, is the stuffer box crimping apparatus wherein the fibers of one or several strands are pushed into a stuffer box with the aid of a pair of feed rollers; this stuffer box is open against resistance at the outlet. It is known to steam the fiber pack within this stuffer box in order to fix the crimped structure. However, it is also customary under practical conditions to steam the synthetic fibers to be crimped prior to entrance into the crimping installation, in order to feed heated fibers to the crimping installation.

The invention is based on the object of developing a steaming device for the rapid and uniform heating of the subsequently to be crimped fibers, wherein the fibers can be heated up to 90°–95° C. without condensate drippings, while continuously traveling through the device, by means of intensive steam spraying treatment.

Starting with the steaming device as set forth in the preamble of the claim, the provision is made, to attain the posed object, to shield the pressurized steam, sprayed out of an opening of a steam feed means, with respect to the fibers which travel past. This is preferably accomplished by means of an at least partially permeable distributor plate extending suitably over the length of the duct and being arranged at a spacing to form a distributor channel with respect to the insulated duct wall. For optimum distribution of steam over the working area of the steaming duct, two superimposed distributor panels are associated with the steam feed opening, the regions where the steam can pass though being offset with respect to one another. In order to obtain a desired steaming temperature and also to vaporize droplets of condensate, it is advantageous to arrange a heater between the two distributor plates. Such a steaming device should be located above and below the threads traveling past and should be designed so that it can be moved away from each other for an easier operation.

Figure 2:
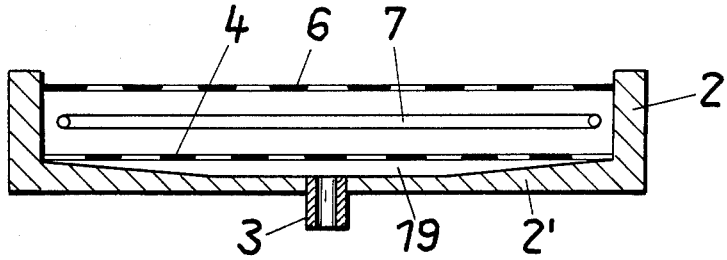
Figure 3:
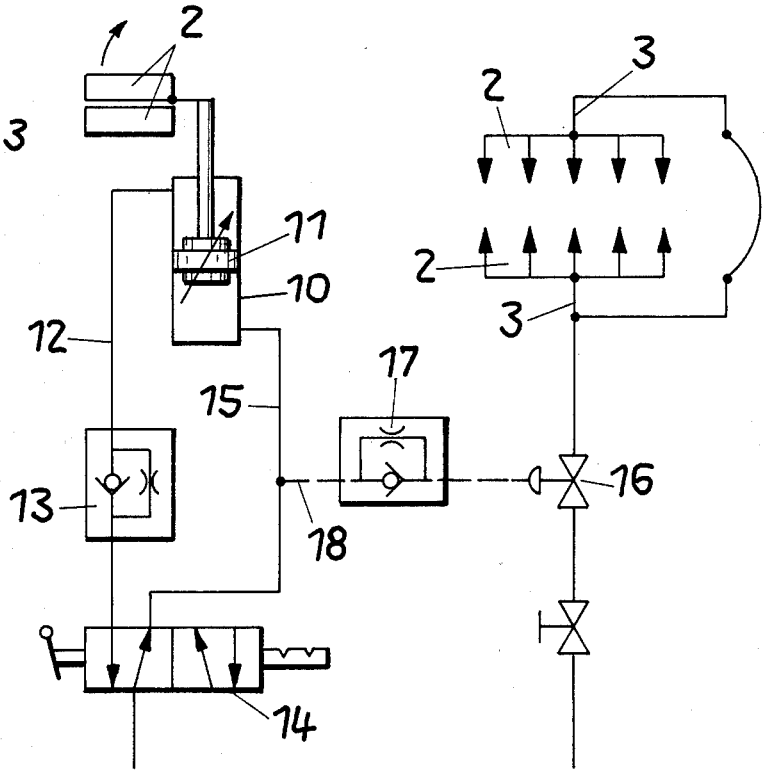

The drawings show one embodiment, and the invention and still further details, which also in combination are significant for the invention, will be described below with reference to these drawings, wherein:

FIG. 1 shows a cross section through a steaming duct in the direction of the longitudinally traveling-through synthetic fibers, FIG. 2 shows a section vertically through the steaming duct of FIG. 1, and FIG. 3 shows a regulating scheme for operating the steaming duct.

The device of FIGS. 1 and 2 is located immediately upstream of a crimping installation. The crimping installation is not shown and can be of any desired construction. A steaming device 20 is disposed above and below the synthetic fibers 1 conducted in stretched condition; each steaming device is, in principle, of identical construction. The steaming device consists of a heat-insulated housing 2 fashioned to be open respectively in the direction of the fibers 1. A steam feed pipe 3 terminates into the housing 2 approximately in the middle thereof. The steam, exiting from this pipe under pressure, does not pass directly to the fibers 1, but rather is uniformly distributed over the working area of the duct with the aid of distributor baffles. A perforated panel 4 is arranged at a spacing from the housing wall 2' in order to form a distributor duct 19; this panel is provided over the area of the duct with, for example, slot-like perforated zones 5. Imperforate regions are located between the perforated zones 5. A second perforated panel 6 is provided at a spacing from the first perforated panel 4; the perforated zones 5 of this panel 6 are arrannged in opposition to imperforate areas of the first perforated panel 4. On account of this construction, a uniform distribution of the steam, entering at 3, over the working area of the duct is ensured.

A heater 7 is disposed over the area of the duct between the two perforated panels 4 and 6; this heater serves for heating the supplied steam to the desired steam temperature and also for a uniform distribution of the thus-supplied steam. A condensation of this steam on the housing walls is prevented by insulating the housing wall. Any possible droplets would be revaporized on the heating means prior to coming into contact with the fibers. Any efflux of steam from the device, troublesome to the operator, is precluded by an exhaust means provided at the inlet and outlet of the steaming device; for this purpose, an exhaust duct 8 is arranged at the two end faces over the operating width, following the steaming zone; this exhaust duct is connected via the pipe 9 to an exhaust fan.

In order to facilitate operation of the steaming device, the two housings are arranged so that they can be swung open in the longitudinal direction of the fiber strand. For lifting the upper housing, pneumatic pressure cylinders 10, shown in FIG. 3, are provided. A regulating scheme according to FIG. 3 is advantageous for operation, this scheme simultaneously containing a safety circuit with steam shut-off valve 16. The pressure cylinder 10, serving for operation of the opening unit, comprises a piston 11. Above the piston the cylinder is connected to a pressure line 12 connected via a delay member 13 for closing the device to a five-way valve 14. Below the piston 11, the cylinder 10 is provided with an additional pressure line 15, likewise connected to the five-way valve 14, but also to the shutoff valve 16 by way of the delay member 17 for opening the steam valve 16. The circuit operates as follows:

Upon opening, pressure is applied via the valve 14 by way of line 12 to the topside of the piston 11. Thereupon, due to the movement of the piston 11 and the construction of the valve 14, the line 15 and also the line 18 leading to the steam valve 16 are emptied, so that the shut-off valve 16 immediately closes off the steam supply. Thus, when opening the device, spraying of the operator by unobstructedly escaping steam is prevented. Upon closing of the two steaming device housings, pressure is applied to line 15, whereupon the piston 11 will move upwardly. This movement takes place with a delay, due to the delay member 13. At the same time, the shutoff valve 16 is opened, but with a delay on account of the delay member 17, so that a renewed feeding of steam is possible only after housings of the steaming device have been completely closed.

What is claimed is:

1. A steaming device to be arranged in front of a synthetic fiber crimping installation for heating the fibers travelling past the device, which comprises:

a steaming duct extending over an operating width of the device;

means for feeding steam to the duct including a pipe having a discharge opening leading to the duct;

means for shielding the opening with respect to the fibers travelling past the device, said shielding means including a first steam permeable distributor panel that extends over the length of the duct and that is arranged at a spacing with respect to an insulated duct wall in order to form a distributor channel, the first distributor panel being partially perforated with spaced openings and having an imperforate area opposite to the steam feed pipe, a second steam permeable distributor panel arranged in superposition and at a mutual spacing from the first distributor panel, the openings of the first distributor panel being laterally offset with respect to openings in the sound distributor panel; and a heater for heating the steam extending over the width of the steaming duct between the two distributor panels.

2. A device according to claim 1, comprising two steaming ducts, one duct extending above and the other duct extending below a path of the fibers.

3. A device according to claim 2, wherein the top and bottom steaming ducts are hingedly joined so that the ducts can be swung open away from each other in the longitudinal direction.

4. A device according to claim 3, wherein one of the steaming ducts is operatively associated with a pneumatic actuating means and is arranged so that said one duct can be moved away pneumatically, and is connected with an automatic steam feed means operating with delay.

5. A device according to claim 1, wherein said distributor panel has openings in the form of pass-through slots which are spaced from each other.

6. A device according to claim 1, wherein said device is provided with a housing which partially surrounds the steaming duct, said housing having an exhaust means located along a peripheral zone for preventing efflux of steam from said device.

* * * * *